US011232682B2

(12) United States Patent
Berman

(10) Patent No.: US 11,232,682 B2
(45) **Date of Patent: *Jan. 25, 2022**

(54) GAMING DEVICE UTILIZING MULTIPLE SYMBOL REPLACEMENT

(71) Applicant: KING SHOW GAMES, INC., Minnetonka, MN (US)

(72) Inventor: Bradley Berman, Minnetonka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/564,785

(22) Filed: Sep. 9, 2019

(65) Prior Publication Data

US 2019/0392686 A1 Dec. 26, 2019

Related U.S. Application Data

(63) Continuation of application No. 14/927,449, filed on Oct. 29, 2015, now Pat. No. 10,410,476.

(60) Provisional application No. 62/072,375, filed on Oct. 29, 2014.

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01); *G07F 17/3246* (2013.01); *G07F 17/3248* (2013.01)

(58) Field of Classification Search
CPC .. G07F 17/34; G07F 17/3246; G07F 17/3248; G07F 17/326
See application file for complete search history.

(56) References Cited

U.S. PATENT DOCUMENTS

| | | | |
|---|---|---|---|
| 5,531,448 | A | 7/1996 | Moody |
| 5,732,950 | A | 3/1998 | Moody |
| 5,807,172 | A | 9/1998 | Piechowiak |
| 5,823,873 | A | 10/1998 | Moody |
| 5,954,335 | A | 9/1999 | Moody |
| 5,976,016 | A | 11/1999 | Moody et al. |
| 5,997,401 | A | 12/1999 | Crawford |

(Continued)

FOREIGN PATENT DOCUMENTS

| | | | |
|---|---|---|---|
| WO | 2007030786 | A2 | 3/2007 |
| WO | 2007089410 | A2 | 8/2007 |

OTHER PUBLICATIONS

Casino Enterprise Management, "Gaming Products New Class III Slots", Mar. 2015, p. 70.

*Primary Examiner* — Tramar Harper
*Assistant Examiner* — Jeffrey K Wong

(57) ABSTRACT

Embodiments of the present invention set forth systems, apparatuses, and methods for involve or otherwise facilitate a multiple symbol replacement process. Accordingly, a gaming device includes a display having a first game grid and a second game grid, and can be configured to replace at least two symbols in the second game grid, with each of the replaced symbols being in separate game reels that form columns in the second grid, when a predetermined symbol appears in the first game grid as part of a determined game outcome. Alternatively, the gaming device may be configured to replace symbols in the second game grid when a predetermined symbol appears in the first game grid, and replace symbols in the first game grid when a predetermined symbol appears in the second game grid.

20 Claims, 8 Drawing Sheets

(56) References Cited

U.S. PATENT DOCUMENTS

| | | | |
|---|---|---|---|
| 6,007,066 | A | 12/1999 | Moody |
| 6,098,985 | A | 8/2000 | Moody |
| 6,120,378 | A | 9/2000 | Moody et al. |
| 6,159,095 | A | 12/2000 | Frahm et al. |
| 6,203,428 | B1 | 3/2001 | Giobbi et al. |
| 6,270,412 | B1 | 8/2001 | Crawford et al. |
| 6,280,328 | B1 | 8/2001 | Holch et al. |
| 6,311,978 | B1 | 11/2001 | Moody |
| 6,315,291 | B1 | 11/2001 | Moody |
| 6,364,313 | B1 | 4/2002 | Moody |
| 6,419,578 | B1 | 7/2002 | Moody et al. |
| 6,517,074 | B1 | 2/2003 | Moody et al. |
| 6,517,433 | B2 | 2/2003 | Loose et al. |
| 6,533,273 | B2 | 3/2003 | Cole et al. |
| 6,561,898 | B2 | 5/2003 | Moody |
| 6,568,680 | B1 | 5/2003 | Moody et al. |
| 6,612,574 | B1 | 9/2003 | Cole et al. |
| 6,612,575 | B1 | 9/2003 | Cole et al. |
| 6,652,377 | B1 | 11/2003 | Moody |
| 6,652,378 | B2 | 11/2003 | Cannon |
| 6,656,040 | B1 | 12/2003 | Brosnan et al. |
| 6,672,959 | B2 | 1/2004 | Moody et al. |
| 6,755,738 | B2 | 6/2004 | Glasson et al. |
| 6,832,957 | B2 | 12/2004 | Falconer |
| 6,860,810 | B2 | 3/2005 | Cannon |
| 6,921,334 | B1 | 7/2005 | Bennett |
| 6,955,356 | B2 | 10/2005 | Moody |
| 6,964,418 | B2 | 11/2005 | Moody |
| 7,011,581 | B2 | 3/2006 | Cole et al. |
| 7,137,628 | B2 | 11/2006 | Moody |
| 7,156,397 | B2 | 1/2007 | Moody et al. |
| 7,156,735 | B2 | 1/2007 | Brosnan et al. |
| 7,222,857 | B2 | 5/2007 | Moody |
| 7,222,858 | B2 | 5/2007 | Moody |
| 7,381,133 | B2 | 6/2008 | Thomas |
| 7,404,762 | B2 | 7/2008 | Moody |
| 7,431,644 | B2 | 10/2008 | Moody |
| 7,494,413 | B2 | 2/2009 | Singer et al. |
| 7,527,557 | B2 | 5/2009 | Jackson |
| 7,601,062 | B2 | 10/2009 | Cole et al. |
| 7,927,204 | B2 | 4/2011 | DeBrabander, Jr. et al. |
| 8,105,145 | B2 | 1/2012 | Jaffe |
| 8,251,794 | B2 | 8/2012 | O'Halloran |
| 8,388,435 | B2 | 3/2013 | Anderson et al. |
| 8,545,319 | B2 | 10/2013 | Kaneko |
| 8,608,544 | B2 | 12/2013 | Aoki et al. |
| 2003/0045354 | A1 | 3/2003 | Giobbi |
| 2003/0083121 | A1 | 5/2003 | Cole et al. |
| 2003/0216165 | A1 | 11/2003 | Singer et al. |
| 2004/0033829 | A1 | 2/2004 | Pacey et al. |
| 2005/0101368 | A1 | 5/2005 | Thomas |
| 2005/0233794 | A1 | 10/2005 | Cannon |
| 2006/0025215 | A1 | 2/2006 | Thomas |
| 2006/0281531 | A1 | 12/2006 | Takeda |
| 2007/0060289 | A1 | 3/2007 | Hood |
| 2007/0287529 | A1 | 12/2007 | Kojima |
| 2008/0108409 | A1 | 5/2008 | Cole et al. |
| 2008/0125209 | A1 | 5/2008 | Pacey et al. |
| 2008/0274786 | A1 | 11/2008 | Wilson |
| 2008/0274788 | A1 | 11/2008 | Wilson |
| 2008/0287178 | A1 | 11/2008 | Berman et al. |
| 2009/0069070 | A1* | 3/2009 | Crowder, Jr. ..... G07F 17/3211 463/20 |
| 2009/0131145 | A1 | 5/2009 | Aoki et al. |
| 2009/0239631 | A1 | 9/2009 | Aoki et al. |
| 2010/0004049 | A1 | 1/2010 | Ching et al. |
| 2010/0016058 | A1 | 1/2010 | Englman et al. |
| 2010/0173694 | A1 | 7/2010 | Tsuchida |
| 2010/0197385 | A1 | 8/2010 | Aoki et al. |
| 2010/0234092 | A1 | 9/2010 | Gomez et al. |
| 2010/0248811 | A1 | 9/2010 | Jaffe et al. |
| 2011/0105218 | A1* | 5/2011 | Anderson ..... G07F 17/32 463/20 |
| 2011/0117987 | A1 | 5/2011 | Aoki et al. |
| 2011/0117989 | A1 | 5/2011 | Kennedy et al. |
| 2011/0223985 | A1 | 9/2011 | Mizue |
| 2012/0115565 | A1 | 5/2012 | Schwerdling |
| 2012/0122547 | A1 | 5/2012 | Aoki et al. |
| 2013/0017881 | A1 | 1/2013 | Watkins |

* cited by examiner

GAMING DEVICE UTILIZING MULTIPLE SYMBOL REPLACEMENT

RELATED APPLICATIONS

This application is a continuation of U.S. application Ser. No. 14/927,449, filed Oct. 29, 2015, now U.S. Pat. No. 10,410,476, which claims the benefit of Provisional Patent Application No. 62/072,375 filed on Oct. 29, 2014, to which priority is claimed pursuant to 35 U.S.C. § 119(e) and which is incorporated herein by reference in its entirety.

FIELD OF THE INVENTION

This disclosure relates generally to games, and more particularly to systems, apparatuses and methods for implementing multiple symbol replacement methods in gaming devices.

BACKGROUND

Casino games such as poker, slots, and craps have long been enjoyed as a means of entertainment. Almost any game of chance that can be played using traditional apparatus (e.g., cards, dice) can be simulated on a computer. The popularity of casino gambling with wagering continues to increase, as does recreational gambling such as non-wagering computer game gambling. It is also likely that most new games will be implemented, at least in part, using computerized apparatus.

One reason that casino games are widely implemented on computerized apparatus is that computerized games are highly adaptable, easily configurable and re-configurable, and require minimal supervision to operate. For example, the graphics and sounds included in such games can be easily modified to reflect popular subjects, such as movies and television shows.

Computer gaming devices can also be easily adapted to provide entirely new games of chance that might be difficult to implement using mechanical or discrete electronic circuits. Because of the ubiquity of computerized gaming machines, players have come to expect the availability of an ever wider selection of new games when visiting casinos and other gaming venues. Playing new games adds to the excitement of "gaming" As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill. In some jurisdictions, the absence of skill when determining awards during game play is a requirement.

The present disclosure describes methods, systems, and apparatus that provide for new and interesting gaming experiences, and that provide other advantages over the prior art.

SUMMARY

To overcome limitations in the prior art described above, and to overcome other limitations that will become apparent upon reading and understanding the present specification, embodiments of the present invention are directed to an apparatus, system, computer readable storage media, and/or method that involve or otherwise facilitate a multiple symbol replacement process. In one embodiment, a gaming device includes a display having a first game grid and a second game grid, and a processor operable to determine a first game outcome to display on the first game grid and determine a second game outcome to display on the second game grid. The processor is further operable to determine if a predetermined symbol appears in the first game grid as a result of the first game outcome. When a predetermined symbol appears in the first game grid, the processor is further operable to replace at least two symbols in the second game grid, each of the replaced symbols being in separate game reels that form columns in the second grid.

In another embodiment, a gaming device includes a display having a first game grid and a second game grid, and a processor operable to determine a first game outcome to display on the first game grid and determine a second game outcome to display on the second game grid. The processor is further operable to determine if a first predetermined symbol appears in the first game grid as a result of the first game outcome, and determine if a second predetermined symbol appears in the second game grid as a result of the second game outcome. When a first predetermined symbol appears in the first game grid, the processor is further operable to replace at least one symbol in the second game grid with the first predetermined symbol. When a second predetermined symbol appears in the second game grid, the processor is further operable to replace at least one symbol in the first game grid with the second predetermined symbol.

DETAILED DESCRIPTION

Figure 1:
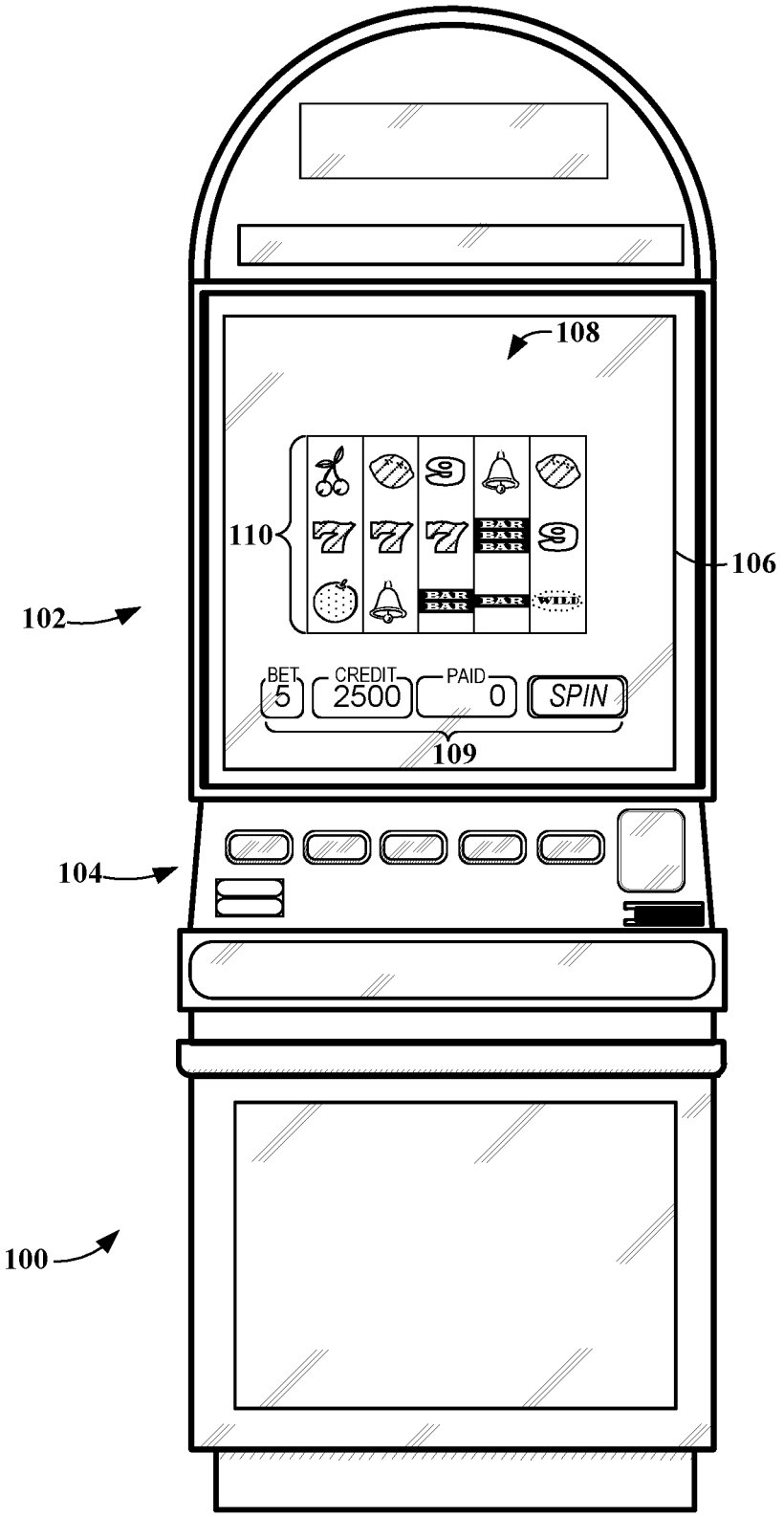
FIG. 1 is a diagram of a gaming machine according to embodiments of the invention.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments.

Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatus.

In various embodiments of the invention, the gaming displays are described in conjunction with the use of data in the form of "symbols." In the context of this disclosure, a "symbol" may generally refer at least to a collection of one or more arbitrary indicia or signs that have some conventional significance. In particular, the symbol represents values that can at least be used to determine whether to award a payout. A symbol may include numbers, letters, shapes, pictures, textures, colors, sounds, etc., and any combination therebetween. A win can be determined by comparing the symbol with another symbol. Generally, such comparisons can be performed via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for enhancing winning result opportunities in gaming activities by providing a multiple symbol replacement process. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) are provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that utilizes operations of a multiple symbol replacement process. In one embodiment, a gaming device includes a display having a first game grid and a second game grid, and a processor operable to determine a first game outcome to display on the first game grid and determine a second game outcome to display on the second game grid. The processor is further operable to determine if a predetermined symbol appears in the first game grid as a result of the first game outcome. When a predetermined symbol appears in the first game grid, the processor is further operable to replace at least two symbols in the second game grid, each of the replaced symbols being in separate game reels that form columns in the second grid.

In another embodiment, a gaming device includes a display having a first game grid and a second game grid, and a processor operable to determine a first game outcome to display on the first game grid and determine a second game outcome to display on the second game grid. The processor is further operable to determine if a first predetermined symbol appears in the first game grid as a result of the first game outcome, and determine if a second predetermined symbol appears in the second game grid as a result of the second game outcome. When a first predetermined symbol appears in the first game grid, the processor is further operable to replace at least one symbol in the second game grid with the first predetermined symbol. When a second predetermined symbol appears in the second game grid, the processor is further operable to replace at least one symbol in the first game grid with the second predetermined symbol.

Numerous variations are possible using these and other embodiments of the inventive concept. Some of these embodiments and variations are discussed below with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, or other games of chance. Some of these other types of embodiments will be discussed below as variations to the examples illustrated. However, many other types of games can implement similar techniques and fall within the scope of this inventive concept.

Referring to the example gaming apparatus 100 shown in FIG. 1, the gaming apparatus includes a display area 102 (also referred to as a gaming display), and a player interface area 104, although some or all of the interactive mechanisms included in the user interface area 104 may be provided via graphical icons used with a touch screen in the display area 102 in some embodiments. The display area 102 may include one or more game displays 106 (also referred to as "displays" or "gaming displays") that may be included in physically separate displays or as portions of a common large display. Here, the game display 106 includes a primary game play portion 108 that displays game elements and symbols 110, and an operations portion 109 that can include meters, various game buttons, or other game information for a player of the gaming device 100.

The user interface 104 allows the user to control and engage in play of the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, or any other user input system or mechanism that allows the user to play the particular gaming activity.

The user interface 104 may allow the user or player to enter coins, bills, or otherwise obtain credits through vouchers, tokens, credit cards, tickets, etc. Various mechanisms for entering such vouchers, tokens, credit cards, coins, tickets, etc. are known in the art. For example, coin/symbol input mechanisms, card readers, credit card readers, smart card readers, punch card readers, radio frequency identifier (RFID) readers, and other mechanisms may be used to enter wagers. It is through the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as paytable information associated with a glass/plastic panel on the gaming machine 100 and/or graphical images. The symbols or other indicia associated with the play of the game may be presented on an electronic display device or on mechanical devices associated with a mechanical display. Generally, the display 106 devotes the largest portion of viewable area to the primary gaming portion 108. The primary gaming portion 108 is generally where the visual feedback for any selected game is provided to the user. The primary gaming portion 108 may render graphical objects such as cards, slot reels, dice, animated characters, and any other gaming visual known in the art. The primary gaming portion 108 also typically informs players of the outcome of any particular event, including whether the event resulted in a win or loss.

In some the example embodiments illustrated herein, the primary gaming portion 108 may display a grid (or equivalent arrangement) of game elements 110 or game element positions (also referred to as "reel stop positions" herein). As illustrated in the embodiment shown in FIG. 1, the grid includes three rows and five columns of game elements 110, which may form a game outcome of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as paytables, navigation controls, etc.

As discussed above, embodiments of the invention provide a multiple symbol replacement process for gaming devices. In particular, some of these embodiments provide a multiple symbol replacement process between separate game grids that display separately evaluated game outcomes to determine awards. In some example embodiments, a first game grid is analyzed to determine if a first predetermined symbol is present in the grid as a result of a determined and displayed first game outcome. When the first predetermined symbol does appear in the first game grid, at least one symbol in two separate columns of the second game grid is replaced. These symbols may be replaced by a copy of the first predetermined symbol, or may be replaced with a modified symbol based on the presence of the first predetermined symbol. The location of the symbol to be replaced in the second game grid may correspond to the position of the first predetermined symbol in the first game grid, or may be selected at random.

In some embodiments, additional symbols may be replaced in the second game grid based on the presence of the first predetermined symbol in the first game grid. For example, two vertical symbols may be replaced in a first column or game reel of the second game grid based on the position of the first predetermined symbol in the first game grid, and second pair of vertically related symbols may be replaced in a second column or game reel of the second game grid based on the position of the same first predetermined symbol in the first game grid. This secondary replacement may, in some embodiments, by effectuated by expanding or otherwise modifying the initially replaced symbol in the second game grid. In other embodiments, however, the initial and secondary replacement may be based only on the position of the first predetermined symbol in the first game grid, where the replacement is carried out substantially simultaneously.

In other embodiments, this multiple replacement process may include replacing one or more symbols in a second game grid based on the occurrence of a first predetermined symbol in a first game grid, and then replacing one or more symbols in a third game grid based on the occurrence of at least the replaced symbol in the second game grid. In addition, one or more symbols in the third game grid may also be replaced based on the occurrence of a second predetermined symbol appearing in the second game grid. Hence, symbols in the third game grid may be replaced based on predetermined symbols appearing based on the first determined outcome in the first game grid, and second determined outcome in the second game grid.

In yet other embodiments, this multiple replacement process may include replacing one or more symbols in a second game grid based on the occurrence of a first predetermined symbol in a first game grid, and then replacing one or more symbols in the first game grid based on the occurrence of a second predetermined symbol in the second game grid. This multiple replacement process can have replacements in both game grids depending on the first and second game outcomes.

In some embodiments, the first and second game grids may be evaluated for awards only after any replacements have been made. In other embodiments, however, game grids may be evaluated for awards prior to and after any replacements. In the example using three grids, for instance, there may be three award evaluations: 1) Prior to any replacements; 2) After replacements have been made to the second grid; and 3) After replacements have been made to the third grid. Alternatively, there may only be an evaluation for awards after all the replacements to the second and third grid have been made.

While replacements may be done with "wild" symbols, which generally help build award combinations without blocking or causing issues for other award combinations, various other replacement techniques can be used in various embodiments. For example, in some embodiments, replacing a symbol that is already a wild symbol, may cause the symbol to become a "2× Wild" symbol that doubles any awards including it in a symbol combination. In other embodiments, any symbol to be replaced may simply become a "2×" version of the existing symbol, or any other multiplier value of that symbol. In other embodiments, the replaced symbol may become a scatter type symbol (paid on number of symbols in grid regardless of location), may become bonus initiating symbols, or may be replaced or modified by any other symbol or method.

In yet other embodiments, the replacement technique may include replacing the existing symbol with a "multi-symbol" icon in the grid position. For example, if a M1 symbol was being copied over to a symbol position in a different grid that already had an M2 symbol; the resulting position may become an M1/M2 multi-symbol, where either or both symbols could be used in creating pay combinations. A similar technique may be used in other embodiments where a symbol is being copied to a grid position already containing that symbol. For example, an M1 symbol being copied to another location with an existing M1 symbol may modify the grid position into a M1/M1 multi-symbol where both M1s could be used in a symbol combination. In this example, for instance, another adjacent M1 symbol could generate a three-symbol M1 combination. Alternatively, this situation may have two different two-symbol M1 combinations.

Figure 2A:
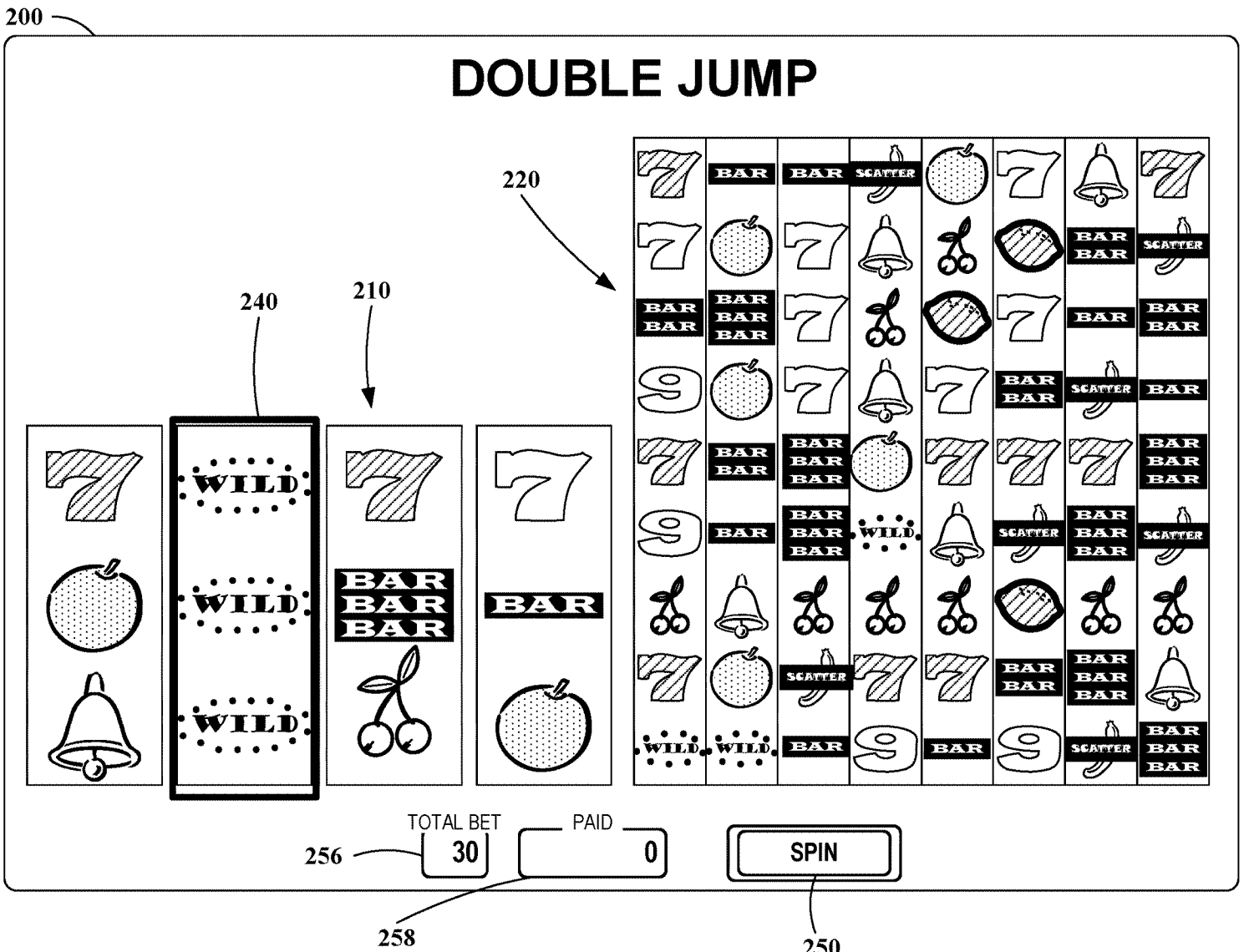
FIGS. 2A and 2B are detail diagrams of a gaming display showing a game progression utilizing a multiple symbol replacement process according to embodiments of the invention.
Figure 2B:
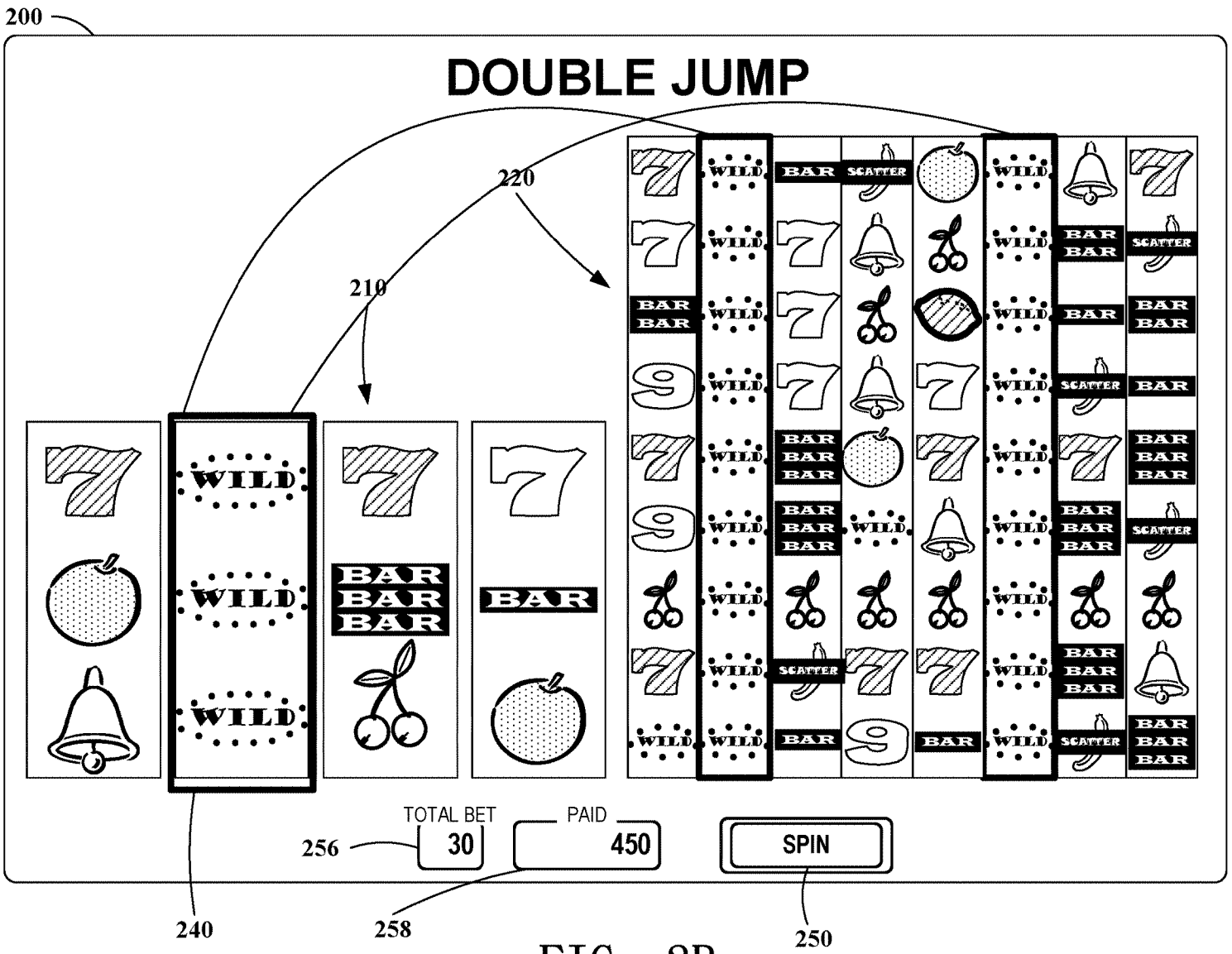

FIGS. 2A-2B, 3, 4, and 5A-5B illustrate some of the embodiments discussed above in detail. Referring to FIGS. 2A and 2B, wild symbols that appear in the first game grid 210 of the game display 200 are copied over and replace symbols in at least two columns or reels in the second game grid 220. As shown in FIG. 2B, since a stack of wild symbols 240 is received on the first game grid 240, the entire columns or reels corresponding to the location of the wilds in the first game grid 210 are replaced with wild symbols in the second game grid 220. Since there are four game reels (columns) in the first game grid 210 and eight game reels (columns) in the second game grid 220, this embodiment has the replacement wilds in the second game grid correspond to the location of the predetermined wild symbols 240 in the first game grid. Hence, since the wilds 240 appear in the second game reel in the first game grid, the symbols in the second and sixth reels are replaced by wilds in the second game grid 220. Although this specific relationship exists in this illustrated embodiment, different replacement techniques may be used in other embodiments. For example, reels 2 and 3 may be replaced in other embodiments. In another example, the reels to be replaced in the second grid may be chosen at random. In yet other embodiments, more than two game reels may be replaced or have symbols within them be replaced.

Figure 3:
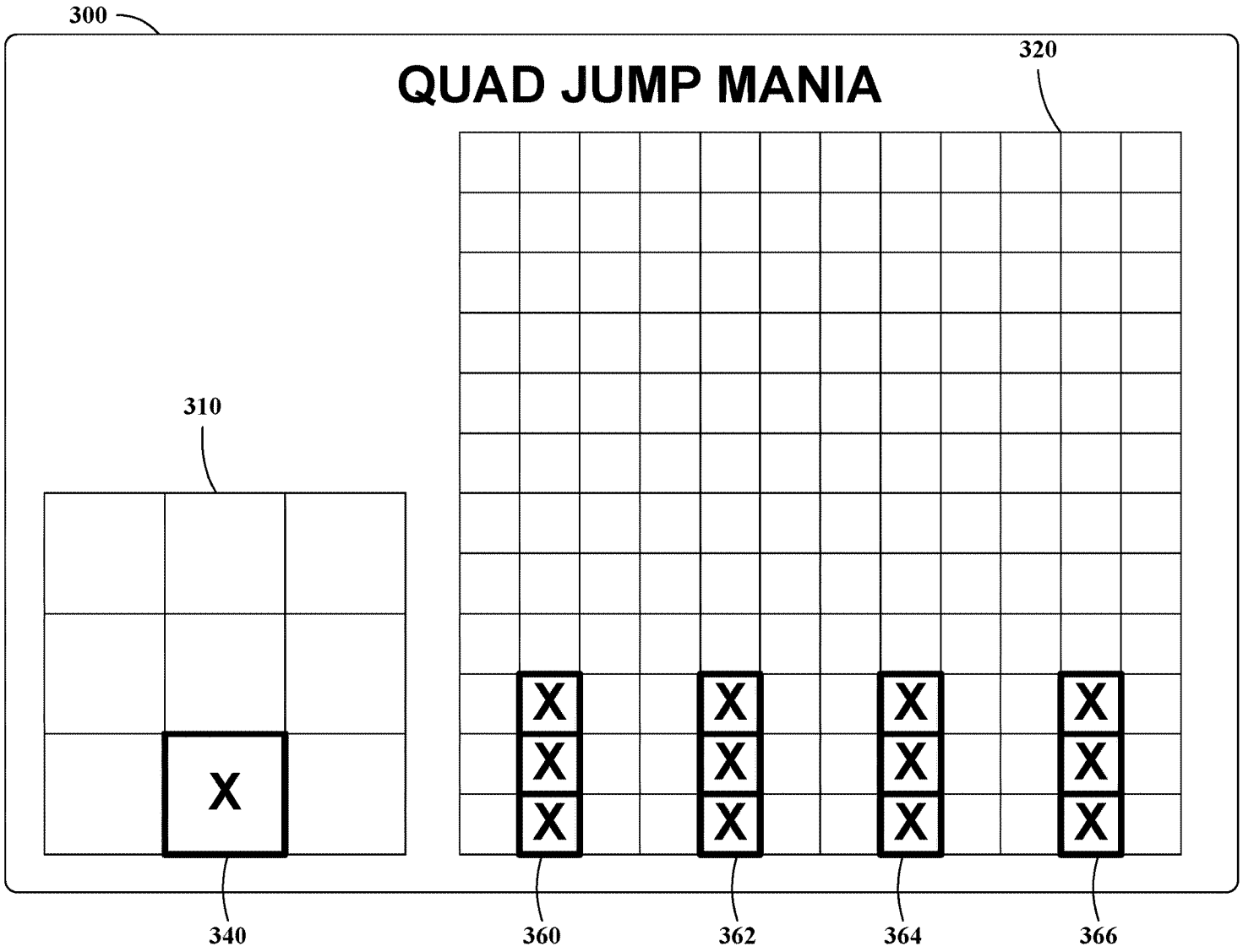
FIG. 3 is a block diagram of a gaming display showing a multiple symbol replacement process according to embodiments of the invention.

Referring to FIG. 3, a game display may have a predetermined symbol 340 in a first game grid 310 replace multiple different locations 360, 362, 364, 366 within a second game grid 320. Here, since the first game grid 310 is a 3×3 grid and the second game grid 320 is a 12×12 grid, corresponding symbol locations related to the bottom row of the second reel of the first game grid may be designated as replacement positions in the second game grid 320. However, many other replacement schemes may be used including selecting random positions in the second game grid for replacement.

Figure 4:
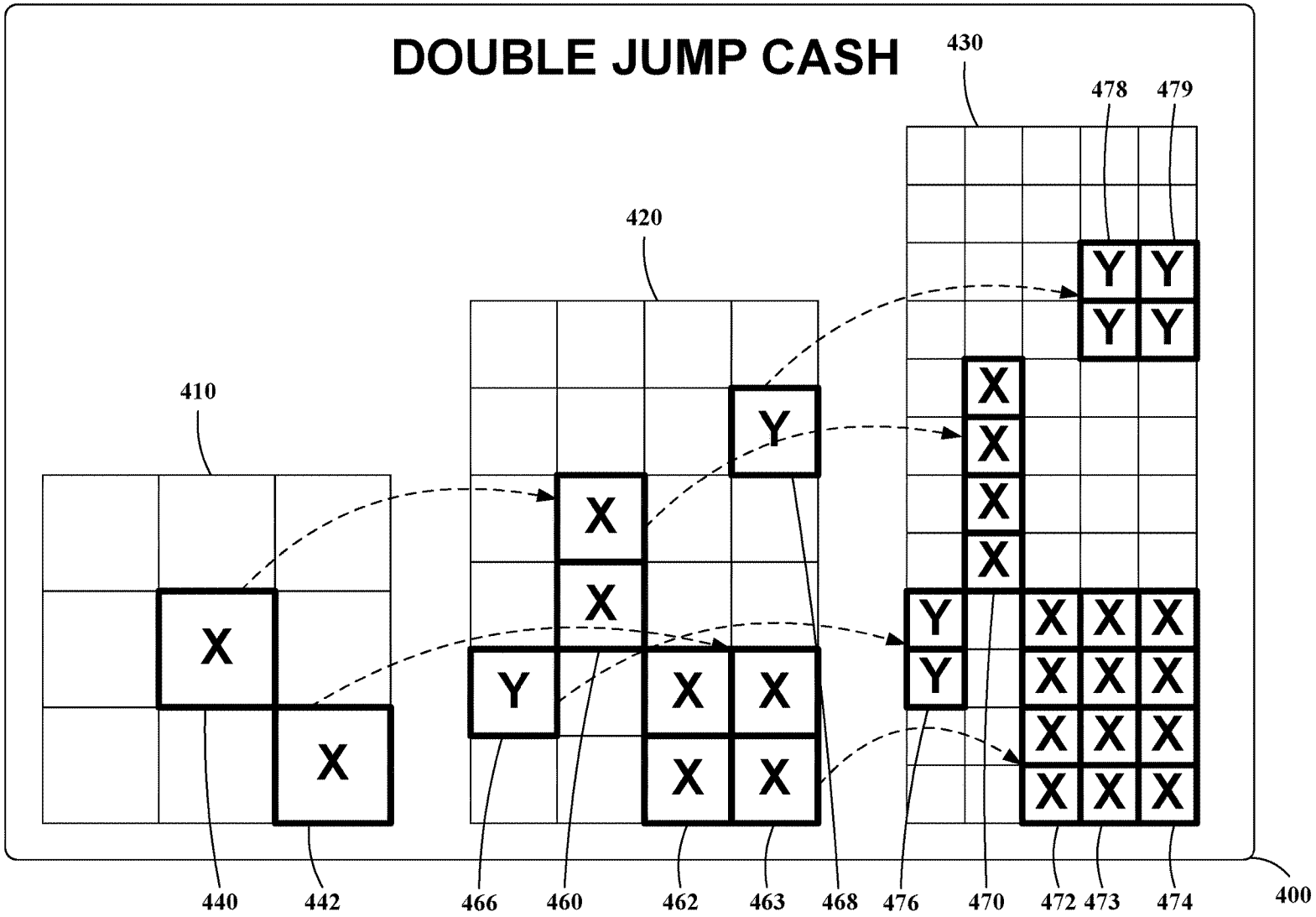
FIG. 4 is a block diagram of a gaming display showing another multiple symbol replacement process according to embodiments of the invention.

Referring to FIG. 4, a gaming display 400 includes a first game grid 410, a second game grid 420, and a third game grid 430. First predetermined symbols 440, 442 landing in the first game grid are copied over and replace corresponding symbols 460, 462, 463 in the second game grid 420. Since the first game grid is a 3×3 grid and the second game grid is a 6×4 game grid, a different replacement technique from the last illustrated embodiment is used. Here, predetermined symbols appearing on the first or second reel of the first game grid 410 are copied to the respective one of the first or second game reels in the second game grid 420. However, predetermined symbols appearing on the third game reel of the first game grid 410 are copied to positions on both the third and fourth reels of the second game grid 420. This technique is illustrated as predetermined symbol 440 in the first game grid 410 is copied to positions 460 in the second game grid 420, while predetermined symbol 442 in the first game grid is copied to positions 462 and 464 in the second game grid.

In addition the predetermined symbols 440, 442 from the first game grid also end up replacing symbols 470, 472, 473, 474 in the third game grid 430. Further, different predetermined symbols 466, 468 appearing in the second game grid 420 are copied over to symbol locations 476, 478, 479 in the third game grid 430. Since the second game grid 420 is a 6×4 grid and the third game grid 430 is a 12×5 grid, a similar replacement technique to that described above is used for replacing symbols from the second game grid to the third game grid.

Figure 5A:
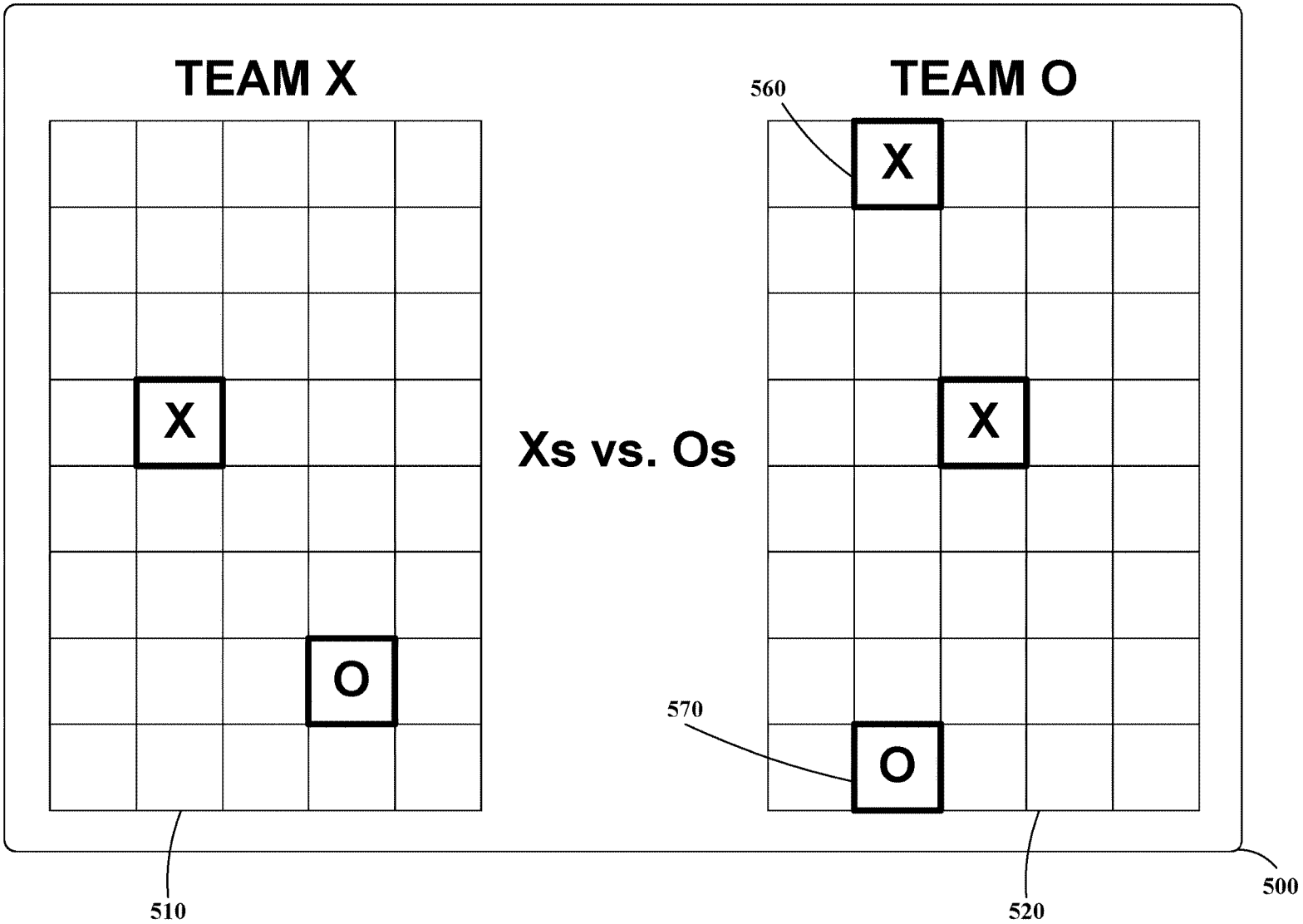
FIGS. 5A and 5 B are block diagrams of a gaming display showing another game progression utilizing a multiple symbol replacement process according to embodiments of the invention.
Figure 5B:
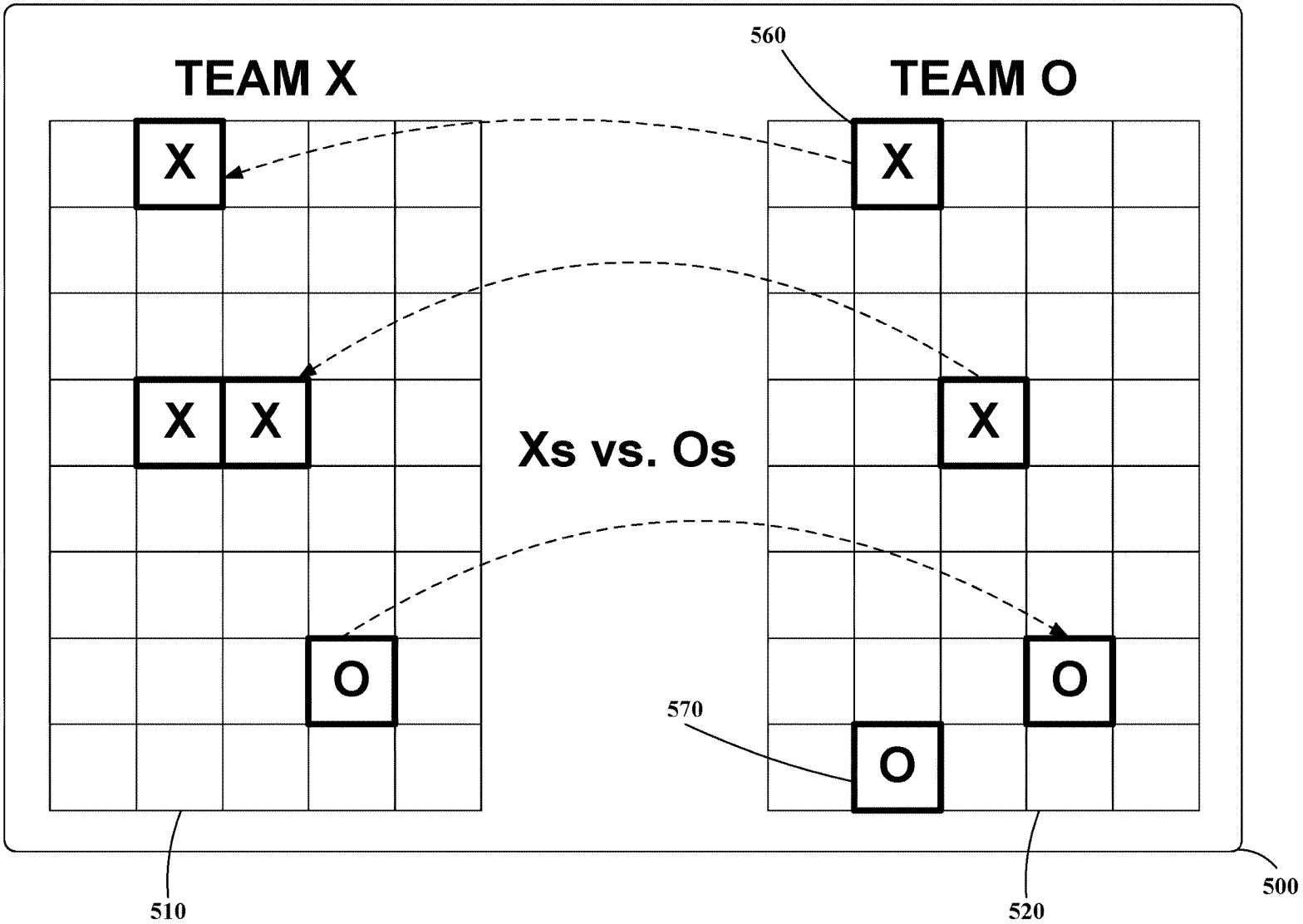

Referring to FIGS. 5A and 5B, a game display 500 includes a first game grid 510 and a second game grid 520. Here, first predetermined symbols 560 and second predetermined symbols 570 may appear in game outcomes in both game grids 510, 520. First predetermined symbols 560 appearing in the first game grid 510 may remain in the first game grid and act as a wild or other type of symbol. Similarly, second predetermined symbols 570 appearing in the second game grid 520 may remain in the second game grid and act as a wild or other type of symbol. However, first predetermined symbols 560 appearing in the second game grid 520 are copied over and replace corresponding symbols in the first game grid 510 as shown in FIG. 5B. Similarly, second predetermined symbols 570 appearing in the first game grid 510 are copied over and replace corresponding symbols in the second game grid 520 as also shown in FIG. 5B.

In some embodiments, if, for example, a first predetermined symbol 560 appearing in the second game grid 570 is copied over to replace a similar first predetermined symbol in the first game grid 510, the existing first predetermined symbol in the first game grid may be modified to a "2×" value of the first predetermined symbol, or create a multi-symbol as described above.

In some embodiments, one or more meters (not shown) may be displayed on the game display where symbols being copied from the first and second grid are counted on the meter to win bonus prizes, progressive awards, or other prizes. In some embodiments, two meters may be displayed on the game display: A first meter corresponding to a number of first predetermined symbols appearing on the first game grid 510 that are copied over to the second game grid 520; and A second meter corresponding to the number of second predetermined symbols appearing in the second game grid that are copied over to the first game grid. In other embodiments, only a single meter may be present that increments for any predetermined symbols that are copied from the first game grid 510 to the second game grid 520 or from the second game grid to the first game grid. As mentioned above, the incremented amounts of the meter may correspond to progressive awards, such as multi-level progressive awards, correspond to bonus prizes, or correspond to other awards such as multipliers used to multiply awards won on the first game grid 510 and/or prizes won on the second game grid 520.

Figure 6:
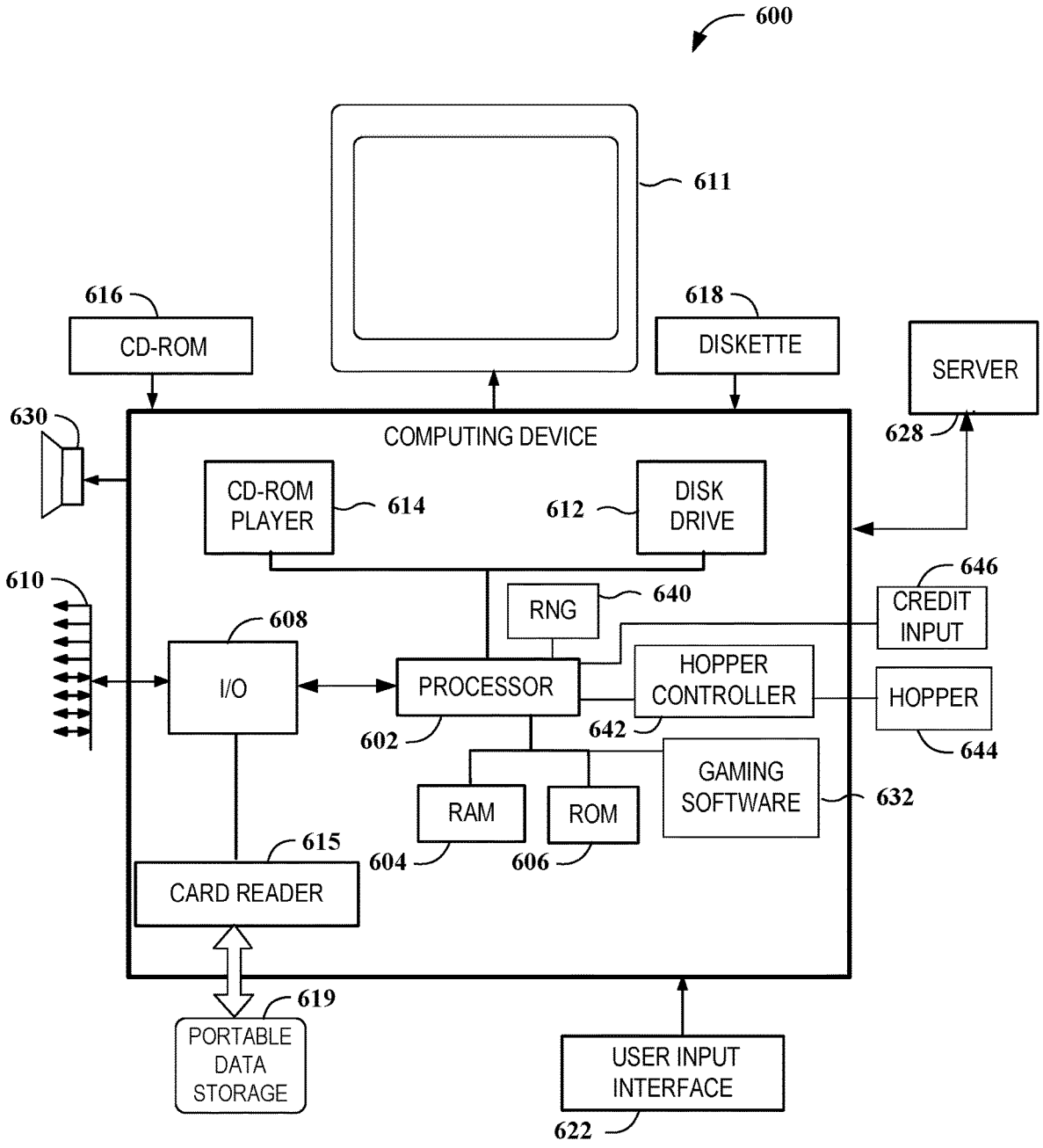
FIG. 6 is a block diagram illustrating a computing arrangement according to embodiments of the invention.

As may now be readily understood, one or more devices may be programmed to play various embodiments of the invention. The present invention may be implemented as a casino gaming machine or other special purpose gaming kiosk as described hereinabove, or may be implemented via computing systems operating under the direction of local gaming software, and/or remotely-provided software such as provided by an application service provider (ASP). The casino gaming machines utilize computing systems to control and manage the gaming activity. An example of a representative computing system capable of carrying out operations in accordance with the invention is illustrated in FIG. 6.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 600 of FIG. 6 is an example computing structure that can be used in connection with such electronic gaming machines, computers, or other computer-implemented devices to carry out operations of the present invention.

The example computing arrangement 600 suitable for performing the gaming functions in accordance with the present invention typically includes a central processor (CPU) 602 coupled to random access memory (RAM) 604 and some variation of read-only memory (ROM) 606. The ROM 606 may also represent other types of storage media to store programs, such as programmable ROM (PROM), erasable PROM (EPROM), etc. The processor 602 may communicate with other internal and external components through input/output (I/O) circuitry 608 and bussing 610, to provide control signals, communication signals, and the like.

The computing arrangement 600 may also include one or more data storage devices, including hard and floppy disk drives 612, CD-ROM drives 614, card reader 615, and other hardware capable of reading and/or storing information such as DVD, etc. In one embodiment, software for carrying out the operations in accordance with the present invention may be stored and distributed on a CD-ROM 616, diskette 618, access card 619, or other form of computer readable media capable of portably storing information. These storage media may be inserted into, and read by, devices such as the CD-ROM drive 614, the disk drive 612, card reader 615, etc. The software may also be transmitted to the computing arrangement 600 via data signals, such as being downloaded electronically via a network, such as the Internet. Further, as previously described, the software for carrying out the functions associated with the present invention may alternatively be stored in internal memory/storage of the computing device 600, such as in the ROM 606.

The computing arrangement 600 is coupled to the display 611, which represents a display on which the gaming activities in accordance with the invention are presented. The display 611 represents the "presentation" of the video information in accordance with the invention, and may be any type of known display or presentation screen, such as liquid crystal displays, plasma displays, cathode ray tubes (CRT), digital light processing (DLP) displays, liquid crystal on silicon (LCOS) displays, etc.

Where the computing device 600 represents a stand-alone or networked computer, the display 611 may represent a standard computer terminal or display capable of displaying multiple windows, frames, etc. Where the computing device is embedded within an electronic gaming machine, the display 611 corresponds to the display screen of the gaming machine/kiosk. A user input interface 622 such as a mouse, keyboard/keypad, microphone, touch pad, trackball, joystick, touch screen, voice-recognition system, etc. may be provided. The display 611 may also act as a user input device, e.g., where the display 611 is a touchscreen device. In embodiments, where the computing device 600 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG). The fixed and dynamic symbols generated as part of a gaming activity may be produced using one or more RNGs. RNGs as known in the art may be implemented using hardware, software operable in connection with the processor 602, or some combination of hardware and software. The present invention is operable using any known RNG, and may be integrally programmed as part of the processor 602 operation, or alternatively may be a separate RNG controller 640.

The computing arrangement 600 may be connected to other computing devices or gaming machines, such as via a network. The computing arrangement 600 may be connected to a network server 628 in an intranet or local network configuration. The computer may further be part of a larger network configuration as in a global area network (GAN) such as the Internet. In such a case, the computer may have access to one or more web servers via the Internet. In other arrangements, the computing arrangement 600 may be configured as an Internet server and software for carrying out the operations in accordance with the present invention may interact with the player via one or more networks. The computing arrangement 600 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 600 may also include a hopper controller 642 to determine the amount of payout to be provided to the participant. The hopper controller may be integrally implemented with the processor 602, or alternatively as a separate hopper controller 642. A hopper 644 may also be provided in gaming machine embodiments, where the hopper serves as the mechanism holding the coins/tokens of the machine. The wager input module or device 646 represents any mechanism for accepting coins, tokens, coupons, bills, electronic fund transfer (EFT), tickets, credit cards, smart cards, membership/loyalty cards, etc., for which a participant inputs a wager amount. The wager input device 646 may include magnetic strip readers, bar code scanners, light sensors, or other detection devices to identify and validate physical currency, currency-based tickets, cards with magnetized-strips, or other medium inputted into the wager input device. When a particular medium is received in the wager input device 646, a signal may be generated establish or increase an available credit amount stored in the internal memory/storage of the computing device 600, such as in the RAM 604. Thereafter, specific wagers placed on games may reduce the available credit amount, while awards won may increase the available credit amount. It will be appreciated that the primary gaming software 632 may be able to control payouts via the hopper 644 and controller 642 for independently determined payout events.

Among other functions, the computing arrangement 600 provides an interactive experience to players via input interface 622 and output devices, such as the display 611, speaker 630, etc. These experiences are generally controlled by gaming software 632 that controls a primary gaming activity of the computing arrangement 600. The gaming software 632 may be temporarily loaded into RAM 604, and may be stored locally using any combination of ROM 606, drives 612, media player 614, or other computer-readable storage media known in the art. The primary gaming software 632 may also be accessed remotely, such as via the server 628 or the Internet.

The primary gaming software 632 in the computing arrangement 600 is shown here as an application software module. According to embodiments of the present invention, this software 632 provides a slot game or similar game of chance as described hereinabove. For example, the software 632 may present, by way of the display 611, representations of symbols to map or otherwise display as part of a slot based game having reels. However, in other embodiments, the principles of this concept may be applied to poker games or other types of games of chance. One or more aligned positions of these game elements may be evaluated to determine awards based on a paytable. The software 632 may include instructions to provide other functionality as known in the art and described herein, such as shown and described above regarding FIGS. 1-5B.

The foregoing description of the exemplary embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above.

The invention claimed is:

1. A gaming device comprising:

a game display having a first game grid of symbol positions and a second game grid of symbol positions;

a wager input device structured to receive physical currency or currency-based tickets, the currency or currency-based tickets establishing a credit balance, the credit balance being increasable or decreasable based at least on wagering activity; and a processor configured to:

receive a signal to initiate a game of chance in response to placement of a wager, the wager decreasing the credit balance;

determine a first game outcome to display on the first game grid;

determine a second game outcome to display on the second game grid;

determine if a first predetermined symbol appears in the first game grid, and determine if a second predetermined symbol appears in the first game grid, as a result of the first game outcome;

determine if the second predetermined symbol appears in the second game grid, and determine if the second predetermined symbol appears in the first game grid, as a result of the second game outcome;

for the first game grid, copy any first predetermined symbols appearing in the first game grid to replace symbols in the second game grid, and maintain any second predetermined symbols appearing in the first game grid without copying the second predetermined symbols to the second game grid;

for the second game grid, copy any second predetermined symbols appearing in the second game grid to replace symbols in the first game grid, and maintain any first predetermined symbols appearing in the second game grid without copying the first predetermined symbols to the first game grid;

evaluate the first game grid and the second game grid for symbol combinations associated with awards; and provide any awards from the evaluation, where the provided awards increase the credit balance.

2. The gaming device of claim 1, wherein the first predetermined symbol is a stack of identical symbols filling a column of the first game grid.

3. The gaming device of claim 1, wherein the second predetermined symbol is a stack of identical symbols filling a column of the first game grid.

4. The gaming device of claim 1, wherein the first predetermined symbol is a first wild symbol that substitutes for at least one other game symbol.

5. The gaming device of claim 1, wherein the second predetermined symbol is a second wild symbol that substitutes for at least one other game symbol.

6. The gaming device of claim 1, wherein the second predetermined symbol replaces at least two symbols in two separate columns in the first grid.

7. The gaming device of claim 1, wherein the first predetermined symbols are vertically expanded in the second grid to replace additional symbols in the second game grid and wherein the second predetermined symbols are vertically expanded in the first grid to replace additional symbols in the first game grid.

8. The gaming device of claim 1, wherein the first predetermined symbol replaces at least two symbols in two separate columns in the second grid.

9. A gaming device comprising:

a game display having a first game grid of symbol positions and a second game grid of symbol positions;

a wager input device structured to receive physical currency or currency-based tickets, the currency or currency-based tickets establishing a credit balance, the credit balance being increasable or decreasable based at least on wagering activity; and a processor configured to:

receive a signal to initiate a game of chance in response to placement of a wager, the wager decreasing the credit balance;

determine a first game outcome to display on the first game grid;

determine a second game outcome to display on the second game grid;

determine if a first predetermined symbol appears in the first game grid, and determine if a second predetermined symbol appears in the first game grid, as a result of the first game outcome;

determine if the second predetermined symbol appears in the second game grid, and determine if the second predetermined symbol appears in the first game grid, as a result of the second game outcome;

for the first game grid, copy any first predetermined symbols appearing in the first game grid to replace symbols in the second game grid, and maintain any second predetermined symbols appearing in the first game grid without copying the second predetermined symbols to the second game grid;

for the second game grid, copy any second predetermined symbols appearing in the second game grid to replace symbols in the first game grid, and maintain any first predetermined symbols appearing in the second game grid without copying the first predetermined symbols to the first game grid, wherein the second predetermined symbol replaces at least two symbols in two separate columns in the first grid;

evaluate the first game grid and the second game grid for symbol combinations associated with awards; and provide any awards from the evaluation, where the provided awards increase the credit balance.

10. The gaming device of claim 9, wherein the first predetermined symbol is a stack of identical symbols filling a column of the first game grid.

11. The gaming device of claim 9, wherein the second predetermined symbol is a stack of identical symbols filling a column of the first game grid.

12. The gaming device of claim 9, wherein the first predetermined symbol is a first wild symbol that substitutes for at least one other game symbol.

13. The gaming device of claim 9, wherein the second predetermined symbol is a second wild symbol that substitutes for at least one other game symbol.

14. The gaming device of claim 9, wherein the first predetermined symbols are vertically expanded in the second grid to replace additional symbols in the second game grid and wherein the second predetermined symbols are vertically expanded in the first grid to replace additional symbols in the first game grid.

15. The gaming device of claim 9, wherein the first predetermined symbol replaces at least two symbols in two separate columns in the second grid.

16. A gaming device comprising:

a game display having a first game grid of symbol positions and a second game grid of symbol positions;

a wager input device structured to receive physical currency or currency-based tickets, the currency or currency-based tickets establishing a credit balance, the credit balance being increasable or decreasable based at least on wagering activity; and a processor configured to:

receive a signal to initiate a game of chance in response to placement of a wager, the wager decreasing the credit balance;

display a randomly determined first game outcome on the first game grid;

display a randomly determined second game outcome on the second game grid;

when a first predetermined symbol appears on the first game grid as part of the determined first game outcome:

randomly select a first symbol location in the second grid, copy the first predetermined symbol from the first game grid to the first selected symbol location in the second game grid to replace the symbol previously occupying the first selected symbol location in the second game grid, and when the first selected symbol location in the second game grid is occupied by a second predetermined symbol prior to being replaced by the copied first predetermined symbol from the first game grid, assign a multiplier value to the copied first predetermined symbol in the first selected symbol location in the second game grid;

when a second predetermined symbol appears on the second game grid as part of the determined second game outcome:

randomly select a second symbol location in the first grid, copy the second predetermined symbol from the second game grid to the second selected symbol location in the first game grid to replace the symbol previously occupying the second selected symbol location in the first game grid, and when the second selected symbol location in the first game grid is occupied by a first predetermined symbol prior to being replaced by the copied second predetermined symbol from the second game grid, assign a multiplier value to the copied second predetermined symbol in the second selected symbol location in the first game grid;

evaluate the first game grid and the second game grid for symbol combinations associated with awards; and provide any awards from the evaluation, where the provided awards increase the credit balance.

17. The gaming device of claim 16, wherein the first predetermined symbol is a wild symbol.

18. The gaming device of claim 16, wherein assigning a multiplier value to the copied first predetermined symbol in the first selected symbol location in the second game grid includes assigning a 2× multiplier to the copied first predetermined symbol in the first selected symbol location in the second game grid.

19. The gaming device of claim 16, wherein assigning a multiplier value to the copied second predetermined symbol in the second selected symbol location in the first game grid includes assigning a 2× multiplier to the copied second predetermined symbol in the second selected symbol location in the first game grid.

20. The gaming device of claim 16, wherein the copied first predetermined symbol in the first selected symbol location in the second game grid and the copied second predetermined symbol in the second selected symbol location in the first game grid are each vertically expanded to replace additional symbols in each of the first game grid and the second game grid, respectively.

* * * * *